US007581979B2

(12) United States Patent
Kumakura

(10) Patent No.: US 7,581,979 B2
(45) Date of Patent: Sep. 1, 2009

(54) FLAT CIRCUIT DEVICE

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/149,222

(22) Filed: Apr. 29, 2008

(65) Prior Publication Data

US 2008/0214065 A1 Sep. 4, 2008

(51) Int. Cl.
*H01R 11/20* (2006.01)

(52) U.S. Cl. ..... 439/422; 174/117 FF

(58) Field of Classification Search ..... 439/422, 439/423; 174/117 F, 117 FF
See application file for complete search history.

(56) References Cited

U.S. PATENT DOCUMENTS

| | | | | |
|---|---|---|---|---|
| 5,413,659 | A * | 5/1995 | Koskenmaki et al. | 156/229 |
| 6,394,836 | B2 * | 5/2002 | Nagai | 439/422 |
| 6,565,377 | B2 * | 5/2003 | Sawayanagi et al. | 439/422 |
| 7,273,388 | B2 * | 9/2007 | Kumakura | 439/422 |
| 7,316,581 | B2 * | 1/2008 | Kumakura | 439/422 |
| 7,329,141 | B2 * | 2/2008 | Kumakura et al. | 439/422 |
| 7,338,310 | B2 * | 3/2008 | Kumakura | 439/422 |
| 7,448,128 | B2 * | 11/2008 | Kumakura | 29/748 |
| 7,462,062 | B2 * | 12/2008 | Kumakura | 439/422 |
| 2001/0009820 | A1 * | 7/2001 | Nagai | 439/422 |
| 2002/0013082 | A1 * | 1/2002 | Sawayanagi et al. | 439/422 |
| 2002/0013083 | A1 * | 1/2002 | Kuwayama et al. | 439/422 |
| 2002/0013084 | A1 * | 1/2002 | Asakura et al. | 439/422 |
| 2003/0003795 | A1 * | 1/2003 | Enomoto et al. | 439/422 |
| 2004/0063351 | A1 * | 4/2004 | Enomoto et al. | 439/422 |
| 2006/0228930 | A1 * | 10/2006 | Kumakura | 439/422 |
| 2006/0246768 | A1 * | 11/2006 | Kumakura | 439/422 |
| 2006/0264092 | A1 * | 11/2006 | Kumakura et al. | 439/422 |
| 2007/0044301 | A1 * | 3/2007 | Kumakura | 29/747 |
| 2007/0077807 | A1 * | 4/2007 | Kumakura | 439/422 |
| 2007/0093101 | A1 * | 4/2007 | Kumakura | 439/164 |
| 2007/0111613 | A1 * | 5/2007 | Kumakura | 439/851 |
| 2007/0117476 | A1 * | 5/2007 | Kumakura | 439/885 |
| 2008/0214065 | A1 * | 9/2008 | Kumakura | 439/877 |
| 2008/0296044 | A1 * | 12/2008 | Chiang | 174/117 FF |

FOREIGN PATENT DOCUMENTS

| | | |
|---|---|---|
| EP | 1363362 | 11/2003 |
| JP | 2007-173141 | 7/2007 |

* cited by examiner

*Primary Examiner*—Ross N Gushi
(74) *Attorney, Agent, or Firm*—Edwards Angell Palmer & Dodge LLP

(57) ABSTRACT

The present invention is to provide a terminal and a mounting method thereof, which can fit in a conductor of a flat circuit device without increase in cost. A FFC has a conductor of a belt-shape and a covering portion for covering the conductor. The conductor has a groove along a longitudinal direction thereon, and is fixed in a terminal by placing on a bottom wall sandwiched between a pair of crimping pieces of the terminal and by crimping the pair of the crimping pieces.

8 Claims, 10 Drawing Sheets

FLAT CIRCUIT DEVICE

The priority application Number Japan patent application No. 2005-371544 upon which this patent application is based is hereby incorporated by reference.

BACKGROUND OF THE INVENTION

1. Field of the Invention

The present invention relates to a flat circuit device, especially to the flat circuit device having a conductor of a belt-shape and a covering portion, which can attach a terminal to the conductor by placing the conductor on a bottom wall sandwiched between a pair of crimping pieces of a terminal and by crimping the pair of the crimping pieces.

2. Description of the Related Art

A motor vehicle is equipped with a variety of electronic devices. The motor vehicle includes a wire harness for supplying electric power of a battery and control signal of a controller to the electronic devices. The wire harness has an electric wire and a connector. The connector has a housing formed with a synthetic resin, and a terminal received into the housing and connected with an end portion of the electric wire.

The electronic devices mounted in the motor vehicle have been increasing in accordance with multi-functions requested by users. Accordingly, the wire harness has also been increasing in mass and volume.

In order to make the wire harness smaller, the flat circuitry such as FFC (Flexible Flat Cable) and FPC (Flexible Printed Circuit) is proposed as the electric wire.

The flat circuit device has a conductor of a belt-shape and a covering portion for covering the conductor. The flat circuit device has the plurality of the conductors extending in parallel each other and the conductors are each insulated with the covering portion.

EP1363362 discloses that when a terminal is connected to a conductor of a flat circuitry, the conductor is bent to match with a shape of the terminal and the terminal is connected to the conductor. Thereby, the attachment can be certainly performed, and contact failure of the conductor and the terminal can be avoided.

A method of connecting the terminal to the conductor disclosed in EP1363362 requires a metal mold to form the conductor so as to match the shape of the terminal, and a metal mold for crimping the terminal to the conductor. Accordingly, a cost of connecting the terminal tends to increase.

Also, as shown in EP1363362, the conductor may be attached to the terminal by placing the conductor on a pair of crimping pieces of the terminal and crimping the crimping pieces without change in shape by a terminal attached to the conductor. The conductor is formed into a flat shape and changes easily. Therefore, even a minimal force changes the conductor to a complex shape easily. For this reason, the terminal can not certainly connect to the conductor surely so that the conductor is changed into a shape matched to the crimping pieces.

SUMMARY OF THE INVENTION

The present invention provides a terminal which can be mounted on a conductor of a flat circuit device without an increase in cost, and provides a mounting method thereof.

According to a first aspect of the present invention, a flat circuit device includes a belt-shaped conductor, and a covering portion for covering the conductor. The conductor has a groove along a longitudinal direction thereon. The conductor of the flat circuit device is attached to a terminal by placing the conductor on a bottom wall sandwiched between a pair of crimping pieces of the terminal and crimping the pair of the crimping pieces.

With the construction described above, the groove is arranged on the conductor along the longitudinal direction of the conductor. When the pair of the crimping pieces is crimped, pressure is applied to the conductor in a width direction of the conductor. Thereby, the conductor is bent along the groove by applying the pressure. Also, a bent portion of the conductor approaches to the bottom wall. Thus, deformation of the conductor can be controlled by forming the groove on the conductor, and the conductor can be changed to match with a shape of the terminal and the bottom wall.

Preferably, the groove is arranged at the center of the conductor in a width direction.

With the construction described above, when the pair of the crimping pieces is crimped, the conductor is bent along the groove by applying the pressure. Thus, since the conductor is symmetrically bent along a line passing through the center of the conductor in the longitudinal direction, the conductor can be prevented from being bent to one side of the pair of the conductor crimping pieces.

Preferably, at least a pair of the grooves is symmetrically arranged on the conductor along a line at the center in the width direction extending in a longitudinal direction.

Preferably, slope faces sloped in a direction away from the bottom wall are arranged on both ends in the width direction of the conductor.

With the construction described above, the conductor can be bent along the groove toward the bottom wall and the crimping pieces by having the slope face.

The above and other objects and features of this invention will become more apparent from the following description taken in conjunction with the accompanying drawings.

DESCRIPTION OF THE PREFERRED EMBODIMENT

In the following, embodiments of the present invention are explained with reference to FIGS.

Figure 1:
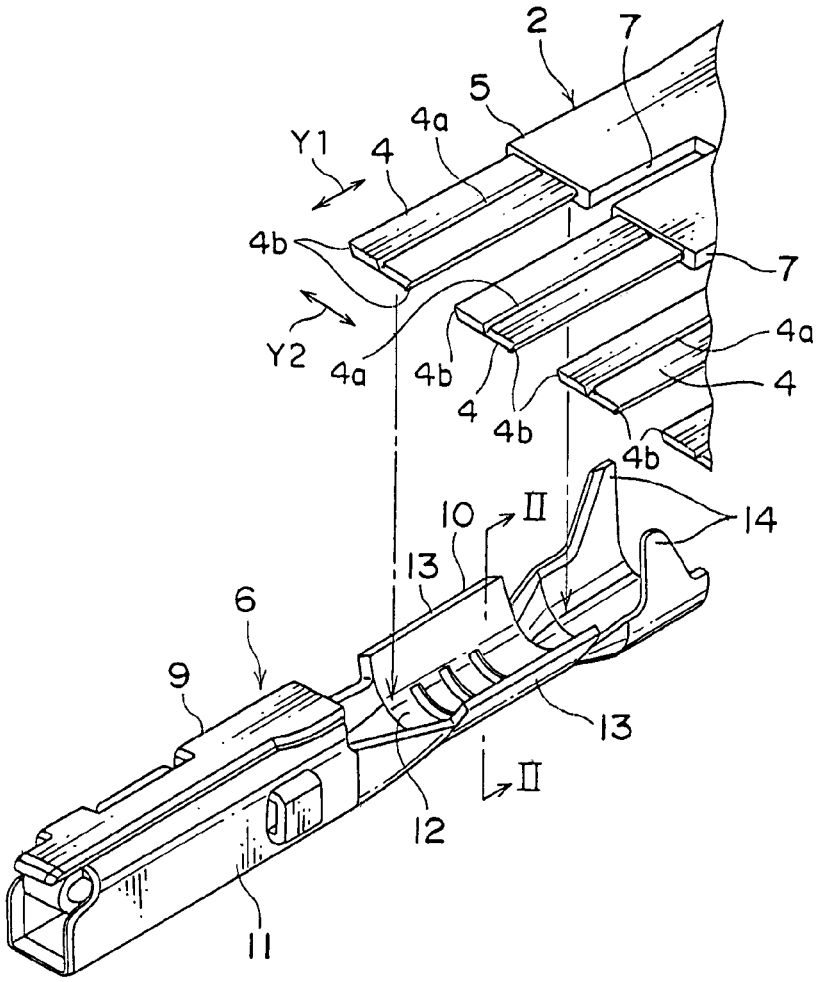
FIG. 1 is a perspective view showing a terminal of the present invention and a FFC mounted on the terminal.

A FFC (Flexible Flat Cable) 2 as the flat circuit device, as shown in FIG. 1, has a plurality of conductors 4 and a covering portion 5 for covering the conductors 4. The FFC 2 has a belt-shape.

The conductors 4 are made of a conductive metal containing at least copper or a copper alloy. The conductors 4 have a rectangle cross-section and extend parallel each other.

The covering portions 5 are made of a synthetic resin insulator having a belt-shape and cover separately the plurality of the conductors 4 for electric insulation. The FFC 2 has the plurality of the conductors 4 at an end thereof where the covering portions 5 are removed. The conductors 4 are separated with silts 7 each other.

The flat circuit described in the present invention shows the flat circuit has a conductor of a belt shape and a insulating covering portions covering the conductor.

A terminal 6 is formed by bending a conductive sheet metal. As shown in FIG. 1, the terminal 6 has an electric contact portion 9 for connecting a mating terminal and an electric connection portion 10 for crimping the conductors 4 of the FFC 2.

The electric contact portion has a rectangular-section tube 11 and a spring, not shown, received in the tube 11. The tube 11 has a square-section in FIG. 1. When an insertion pieces such as a male tab of a mating terminal is inserted into the tube 11, the spring stresses the male tab toward an inner wall of the tube 11 to hold the male tab. Thereby, the electric contact portion 9 electrically and mechanically connects the mating terminal.

Figure 2:
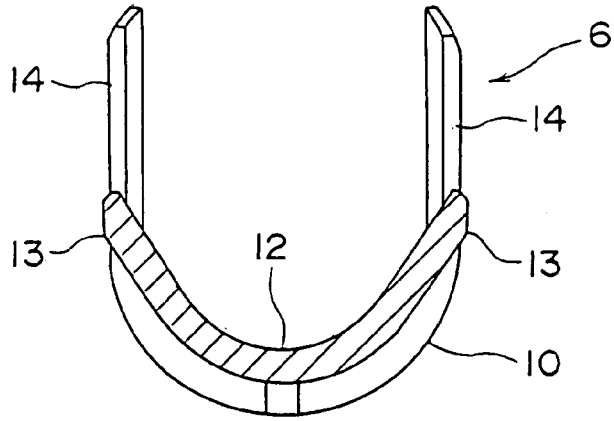
FIG. 2 is a sectional view taken along the line II-II of the terminal and the FFC of FIG. 1.
Figure 3:
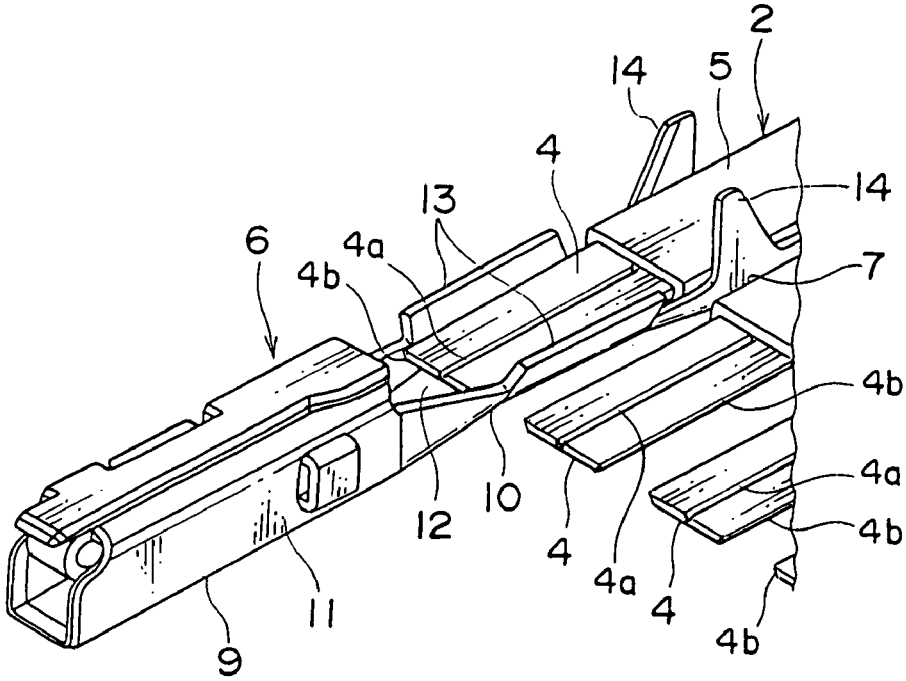
FIG. 3 is a perspective view showing that the conductor is placed on a bottom wall between a pair of conductor crimping pieces of the terminal of FIG. 1.

As shown in FIG. 2, the connection portion 10 has a bottom wall 12 with a circular-section, a pair of conductor crimping pieces 13 and a pair of clad crimping pieces 14. The bottom wall 12 is connected to an outer wall of the tube 11. The conductor 4 disposed at the end of the FFC 2 is placed on the bottom wall 12.

The pair of the conductor crimping pieces 13 forms crimping pieces in the present invention. The conductor crimping pieces 13 are disposed at the center of the bottom wall 12 and upstanding at both sides in a direction of width of the bottom wall 12.

Figure 4:
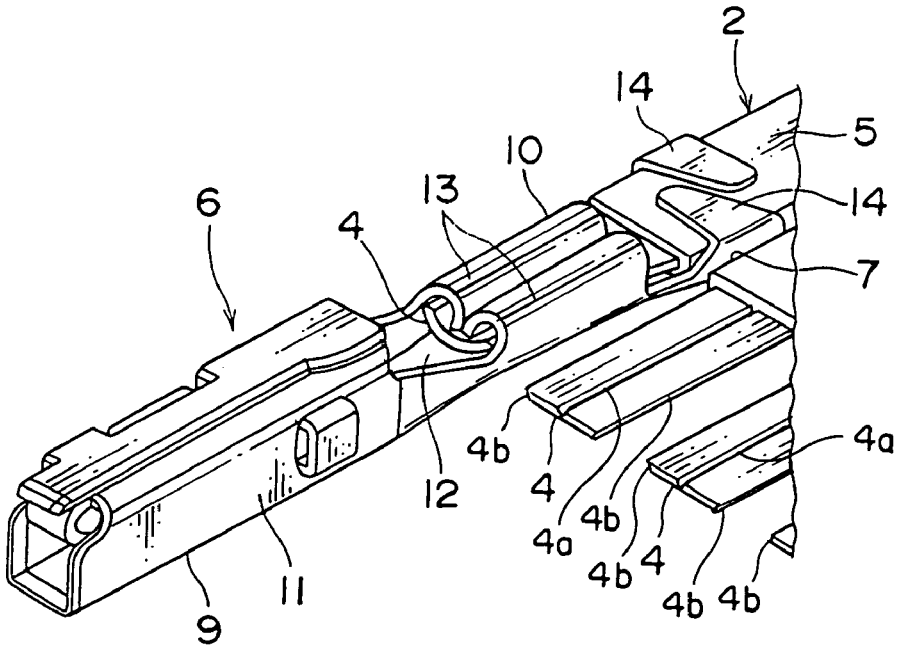
FIG. 4 is a perspective view showing that the conductor crimping pieces of the terminal of FIG. 3 is crimped.

As shown in FIG. 4, the ends of the conductor crimping pieces 13 are bent toward the bottom wall 12 to sandwich the conductor 4 of the FFC 2.

The clad crimping pieces 14 are disposed opposite to the electric contact portion 9 with respect to the bottom wall 12. The clad crimping pieces 14 are disposed in the direction of width of the bottom wall 12 and upstanding at the both ends thereof. As shown in FIG. 4, ends of the clad crimping pieces 14 are bent toward the bottom wall 12 to sandwich the covering portion 5 of the FFC 2.

Figure 5A:
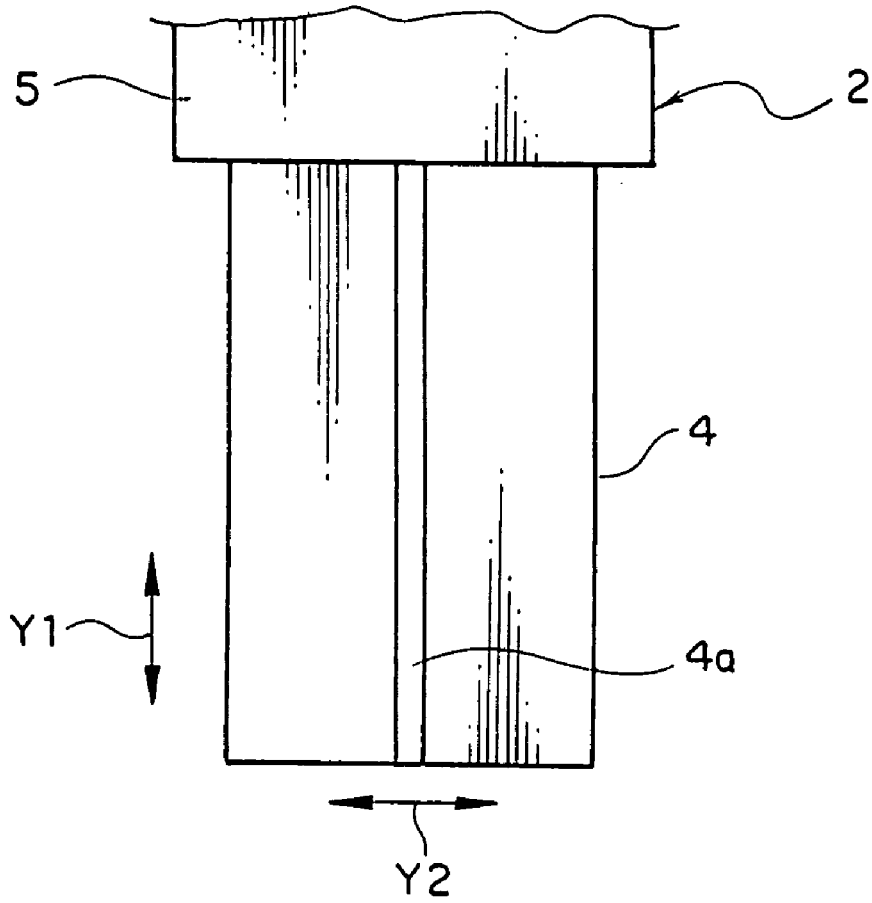
FIG. 5A is a partly top view of the FFC shown in FIG. 1.
Figure 5B:
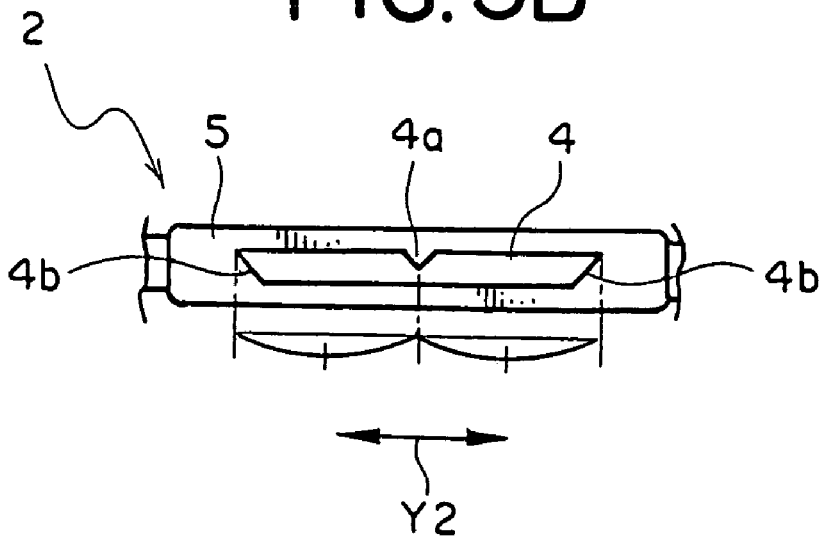
FIG. 5B is a partly front view of the FFC shown in FIG. 1.
Figure 8:
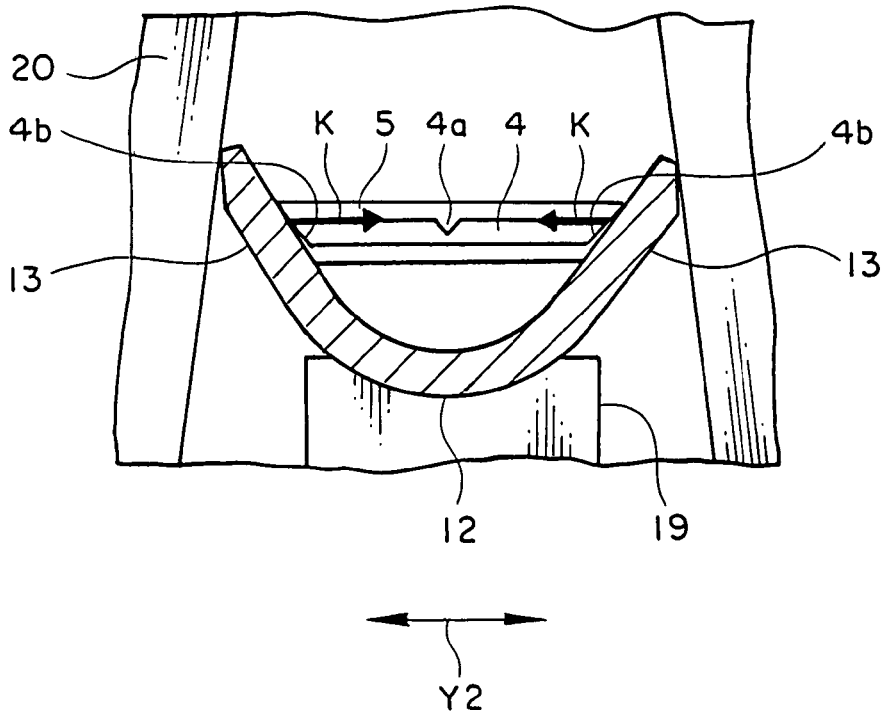
FIG. 8 is a partly enlarged frond view of FIG. 7.

As shown in FIG. 5, a groove 4*a* with a V-shaped section is disposed in the conductor 4 along a longitudinal direction Y1 of the conductor 4. The groove 4*a* is disposed at the center in a width direction Y2 of the conductor 4. The groove 4*a* is disposed in an area covered by the covering portion 5 as well as the conductor 4. The groove 4*a* is formed by pressing a V-shaped die. As shown in FIG. 8, the groove 4*a* is arranged on a surface away from the bottom wall 12 in condition that the conductor 4 is placed on the bottom wall 12. As shown in FIGS. 5B and 8, in condition that the conductor 4 is positioned on the bottom wall, slope faces 4*b* are disposed in the both ends in the width direction Y2 of the conductor 4. The slope faces 4*b* are sloped in a direction away from the bottom wall 12.

Figure 6:
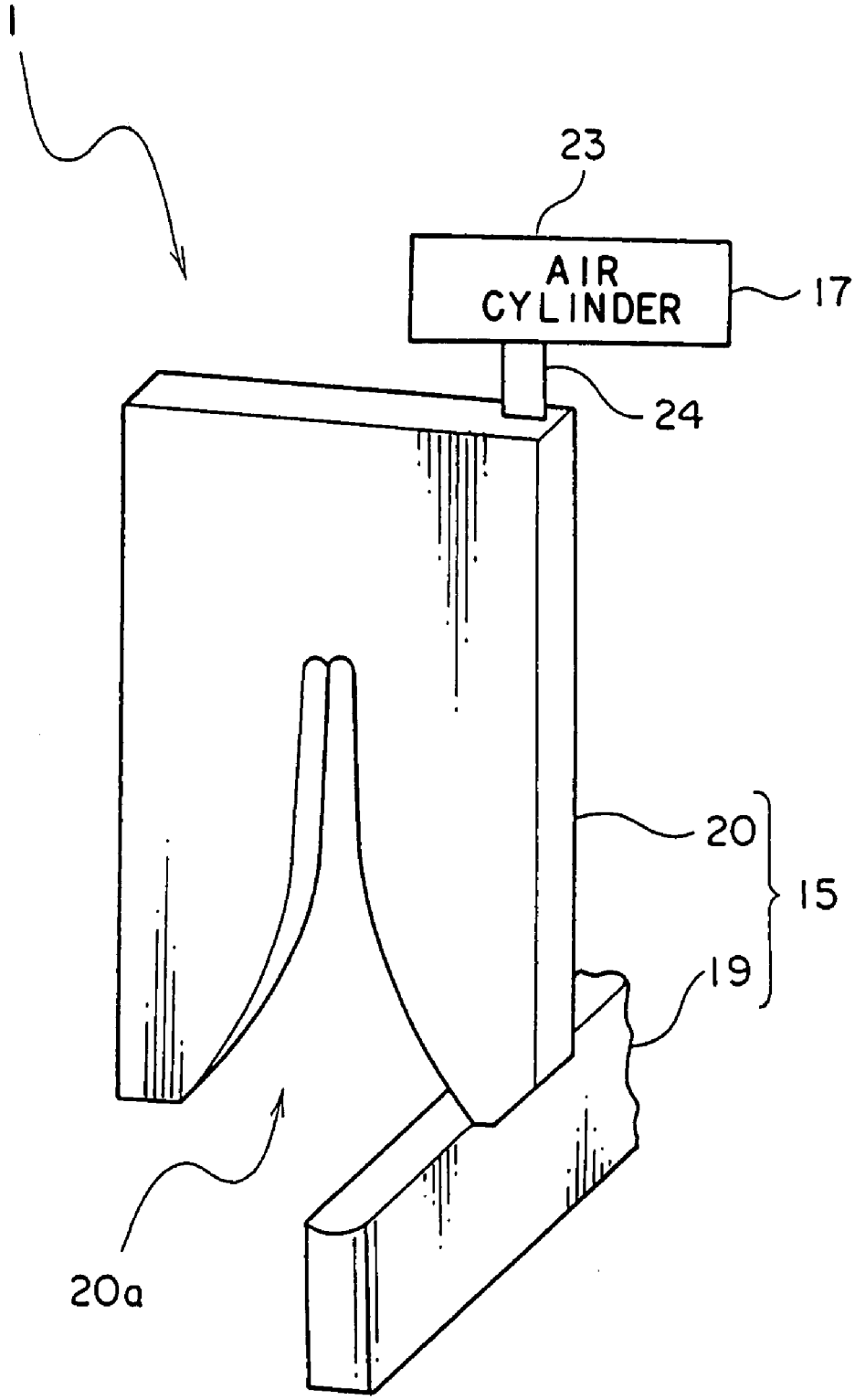
FIG. 6 is one example of a crimping device which crimps the terminal and conductor of FIG. 1.

For example, the ends of the conductor crimping pieces 13 the terminal 6 is bent toward the bottom wall 12 to sandwich the conductor 4, and the ends of the clad crimping pieces 14 are bent toward the bottom wall 12 to sandwich the covering portion 5 by a crimping device 1 shown in FIG. 6. As shown in FIG. 4, the terminal 6 crimps the conductor 4 of the FFC 2 and the covering portion 5 by the crimping pieces 13, 14 of the crimping device 1. Thereby, the terminal 6 is attached to the end of the FFC 2.

As shown in FIG. 6, the crimping device 1 has a main body (not shown), a crimping portion 15 as a way of crimping, and an air cylinder 17 as a drive source. The main body is installed on a floor of a factory.

The crimping portion 15 has an anvil 19 and a crimper 20. The anvil 19 is fixed to the main body and receives the terminal 6 thereon.

The crimper 20 is supported with the main body and is opposed to the anvil 19 and can come close to or off from the anvil 19. The crimper 20 has a slit 20*a* tapered toward the air cylinder 17.

When the anvil 19 and the crimper 20 are separated each other, the terminal 6 and an end portion of the FFC 2 are placed on the anvil 19. The anvil 19 and the crimper 20 come close to each other to sandwich the terminal 6 and the end portion of the FFC 2 and to crimp them with the crimping pieces 13 and 14.

The air cylinder 17 as a drive source has a cylinder 23 and a retractable rod 24 from the cylinder 23. The cylinder 23 is attached to the main body. The rod 24 is attached to the crimper 20. The air cylinder 17 is disposed on area where the crimper 20 comes close to the anvil 19 when the rod 24 is expanded from the cylinder 23, and where the crimper 20 comes off from the anvil 19 when the rod 24 is reduced to the cylinder 23.

Figure 7:
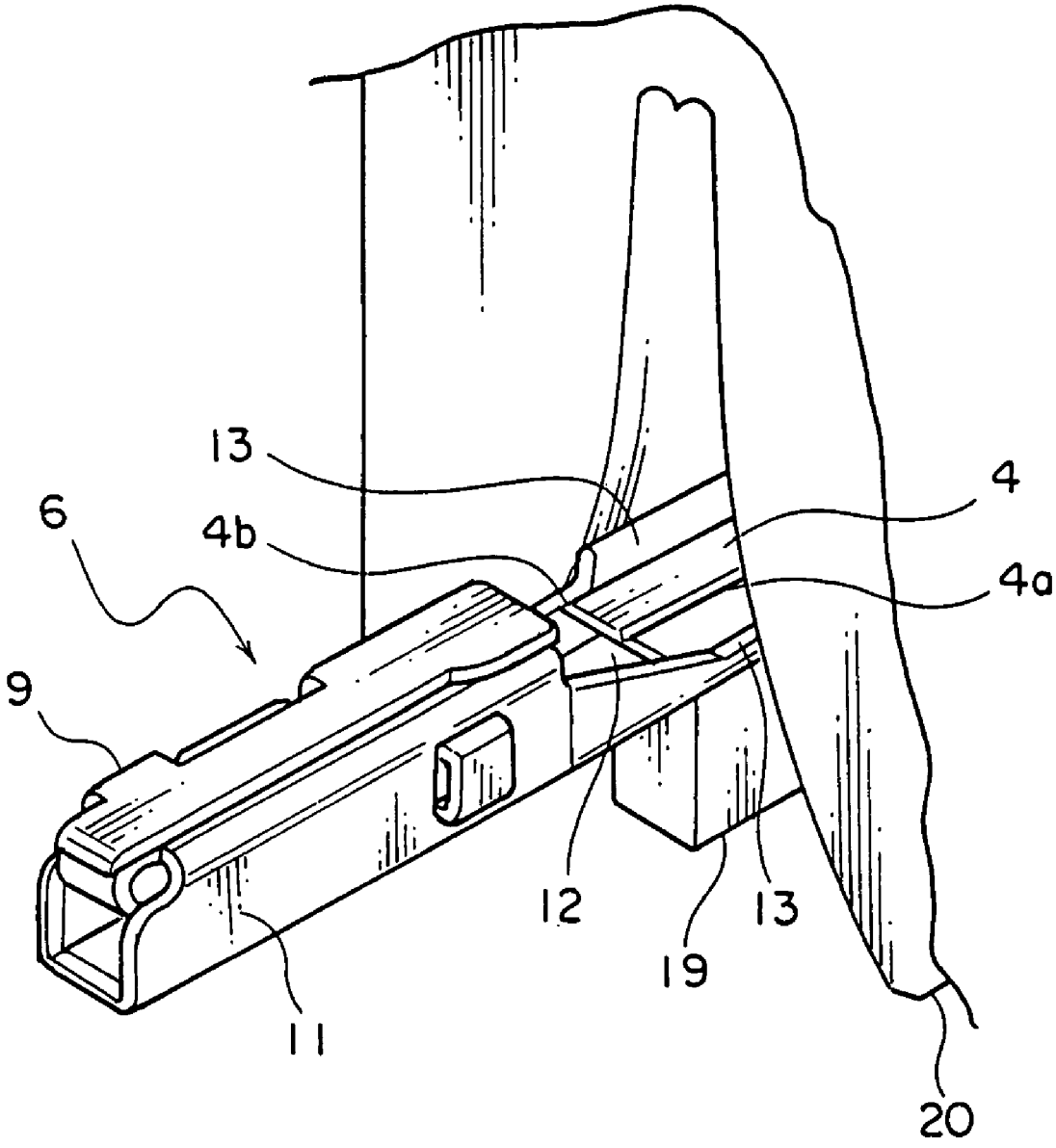
FIG. 7 illustrates that the terminal and the FFC are placed on an anvil of the crimping device shown in FIG. 6.

A method of connecting the terminal 6 to the conductor 4 is described below. As shown in FIG. 7, the anvil 19 and the crimper 20 are separated each other. The terminal 6 is placed on the anvil 19. The conductor 4 exposed from the end portion of the FFC 2 is placed on the bottom wall 12 of the terminal 6. At this time, the bottom wall 12 is positioned closer to the slope face 4*b* of the conductor 4 than the groove 4*a* of the conductor 4.

Figure 9:
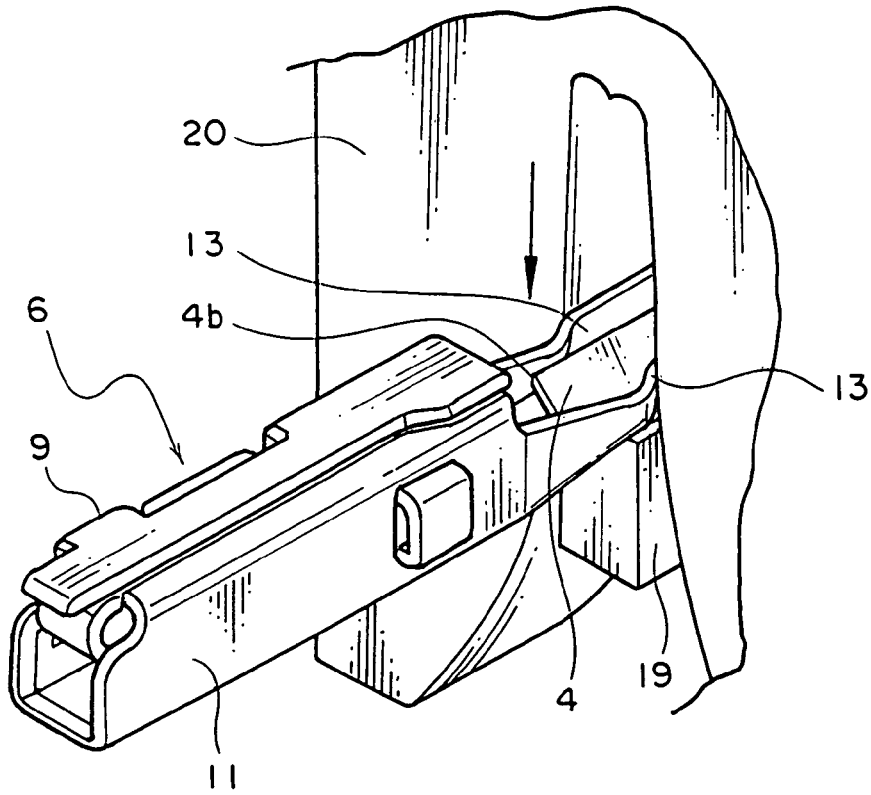
FIG. 9 illustrates that the anvil of FIG. 6 and a crimper approach each other.

Thereafter, the rod 24 of the air cylinder 17 is extended. As shown in FIG. 9, the crimper 20 approaches to the anvil 19. The pair of the crimping pieces 13 is sandwiched between the slit 20*a* arranged on the crimper 20. As described above, width of the slit 20*a* decreases with distance from the anvil 19. Thereby, when the crimper 20 approaches to the anvil 19, a deforming force K (FIG. 10) from a surface of the groove 20*a* of the crimper 20 is applied to the pair of the crimping pieces 13. As a result, the pair of the crimping pieces deforms by approaching to each other.

Figure 10:
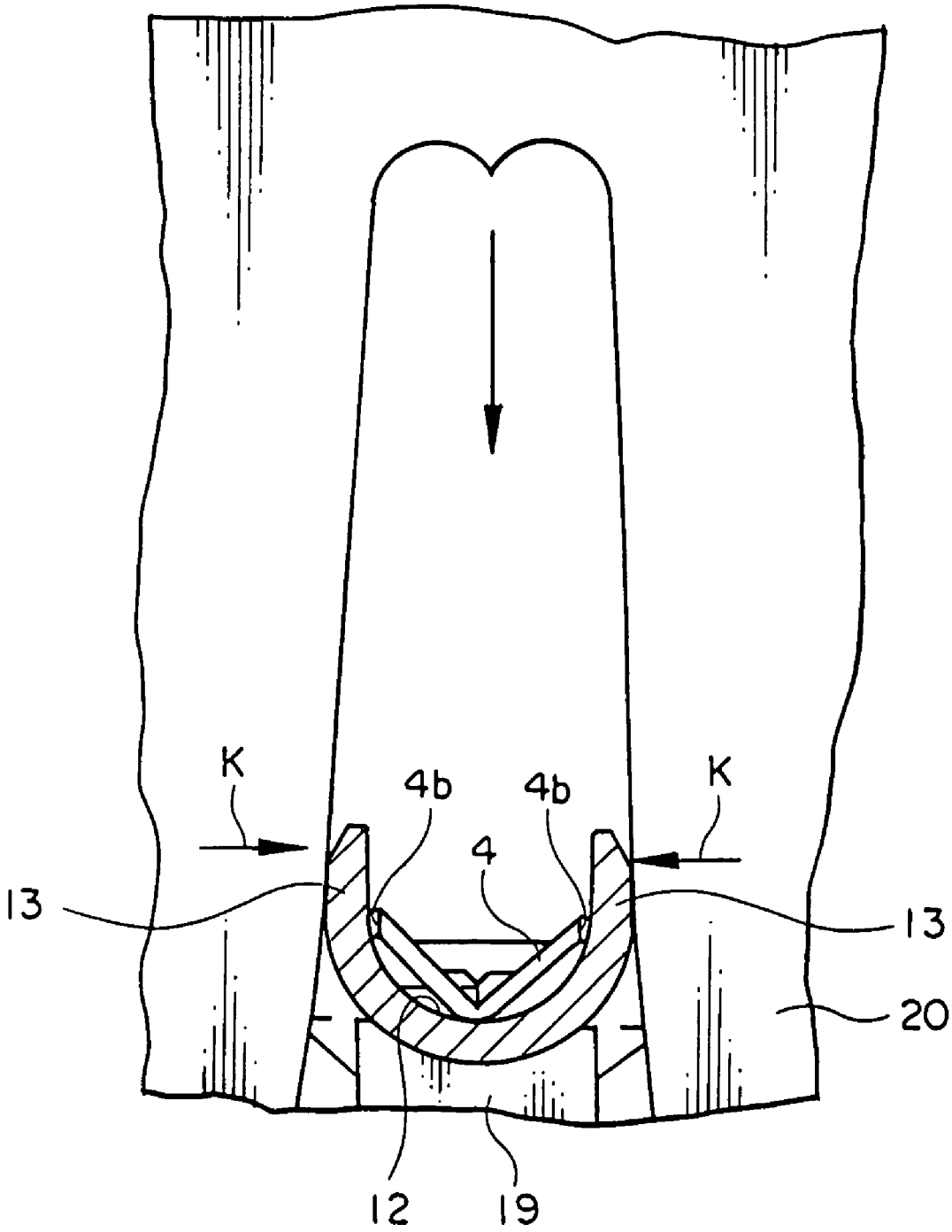
FIG. 10 is a partly enlarged front view of FIG. 9.
Figure 11:
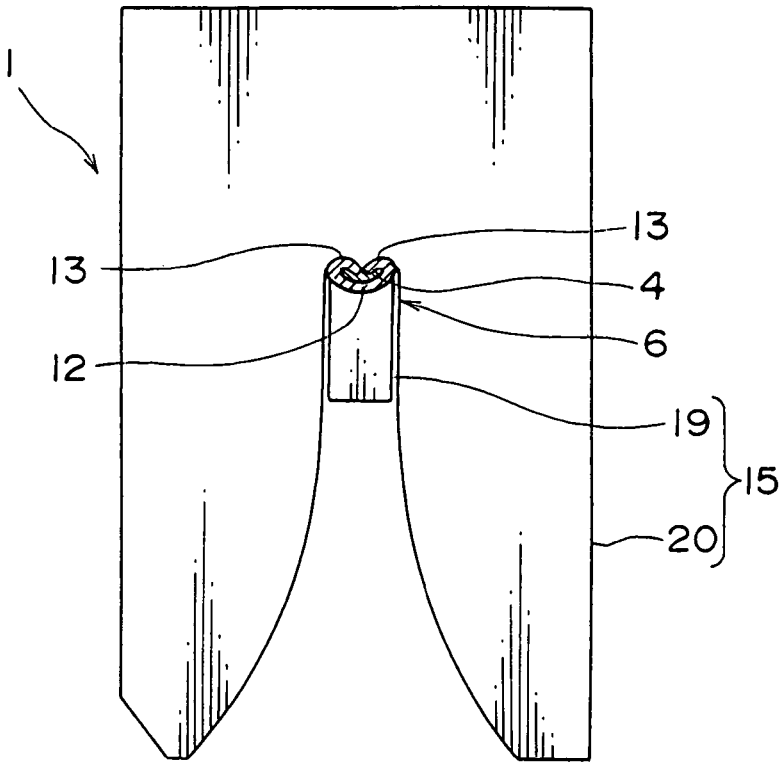
FIG. 11 illustrates that the terminal and the conductor of the FFC is sandwiched between the anvil of FIG. 6 and the crimper.
Figure 12:
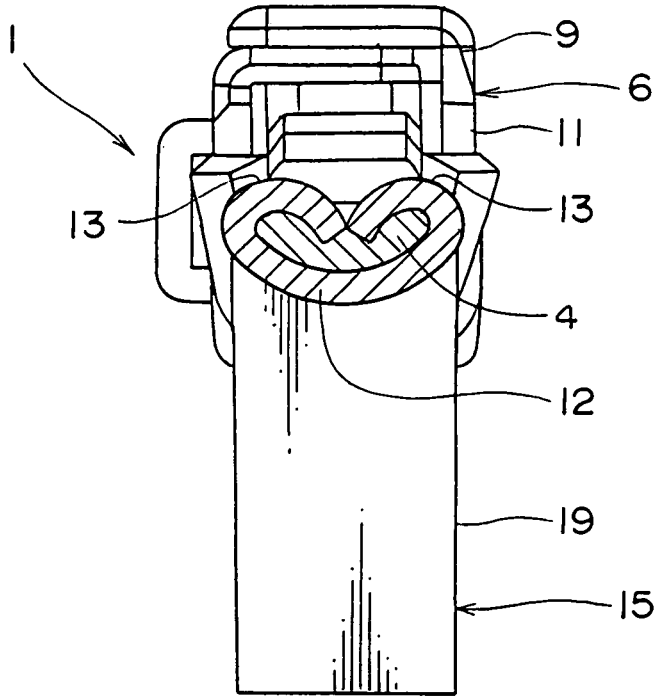
FIG. 12 illustrates the terminal attached to the FFC shown in FIG. 11.

Also, the deforming force K is applied to the conductor 4 through the pair of the crimping pieces 13. As shown in FIG. 10, when the deforming force K is applied to the conductor 4 in the width direction Y2, the conductor 4 is bent along the groove 4*a* arranged at the center of the conductor 4 and deformed. Thereby, a bent portion of the conductor 4 approaches to the bottom wall 12. As shown in FIG. 11, the terminal 6 and the conductor 4 of the FFC is sandwiched between the anvil 19 and the crimper 20, and the crimping pieces 13 and 14 are crimped. Thereby, the terminal 6 is attached to the FFC 2. Finally, as shown in FIG. 12, the conductor 4 is fixed to the terminal 6 by applying press in condition that the conductor 4 is arranged in close contact with the bottom wall 12.

When the rod 24 of the air cylinder 17 is reduced, the anvil 19 and the crimper 20 are separated each other. Thereafter, the terminal 6 on the anvil 19 shown in FIG. 12 is removed. In common with the above described process, the terminal 6 is attached to the FFC 2 by placing the terminal 6 on the anvil 19, and by positioning the conductor 4 of the FFC 2 on the bottom wall 12 of the terminal 6.

According to the above FFC 2 of the present invention, by forming the groove 4*a*, deformation of the conductor 4 can be controlled. Furthermore, the conductor 4 can be deformed depending on deformations of the conductor crimping pieces 13 and the bottom wall 12. As shown in FIG. 12, ultimately, the conductor 4 can be changed without gaps between the conductor 4 and the conductor crimping pieces 13, and between the conductor and the bottom wall 12. Therefore, it is not required to change a shape of the conductor 4 based on the terminal 6 by using a die. The conductor 4 can be attached to the terminal 6 by crimping the conductor crimping pieces 13. Accordingly, increase of a die used in attaching the terminal 6 to the conductor 4 can be prevented. In addition, the conductor 4 can assuredly be attached to the terminal 6 with a low cost.

Furthermore, the conductor 4 can be symmetrically bent along the longitudinal direction Y1 and through the center in the width direction Y2 without deformation of the conductor 4 by being bent to one side of the pair of the conductor crimping pieces 13.

Figure 13:
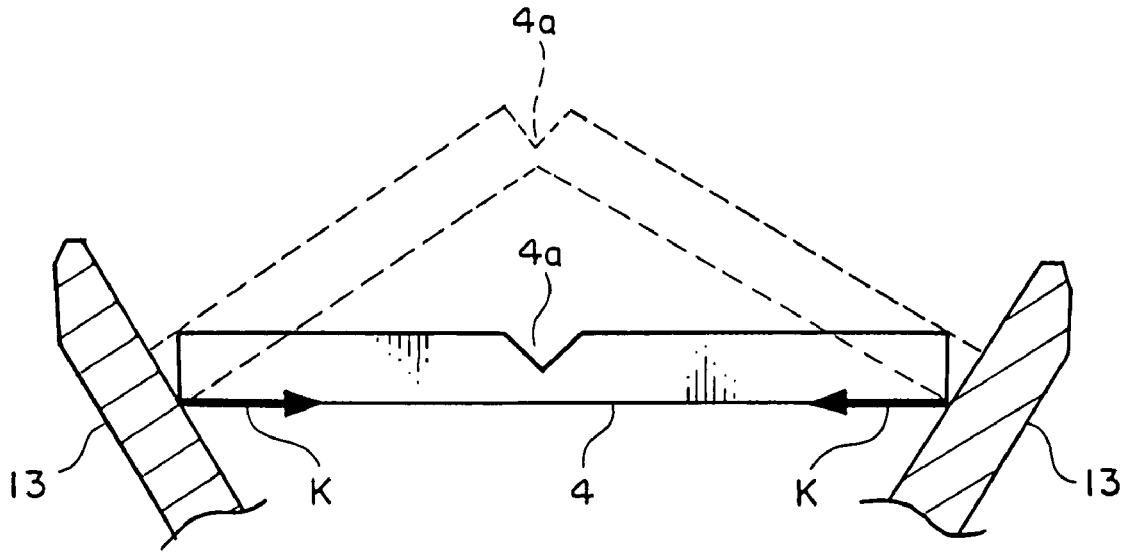
FIG. 13 illustrates problem that a slope face is not arranged on the conductor 4.

Additionally, the conductor 4 has the slope face 4*b*. The slope faces 4*b* are arranged on the both ends in the width direction Y2 of the conductor 4, and are sloped in a direction away from the bottom wall 12. As shown in FIG. 13, when the conductor 4 not arranging the slope face 4*b* is placed on the bottom wall 12, a lower portion of the both ends of the conductor 4 near the bottom wall 12 is sandwiched with the conductor crimping pieces 13. However, an upper portion of the both ends of the conductor 4 is not sandwiched with the conductor crimping pieces 13. Thereby, when the deforming force K is applied to the conductor 4 in the width direction Y2, first the deforming force K is applied to the lower portion of the both ends of the conductor 4. However, then, the deforming force K is not applied to the upper portion of the both ends of the conductor 4. As a result, the conductor 4 can not be bent along the groove 4*a* as shown in FIG. 10. Thereby, as shown in a dotted line of FIG. 13, the conductor 4 could be bent in a direction away from the bottom wall 12.

Therefore, as described above, by arranging the slope face 4*b* on the both ends of the conductor 4, the deforming force K can be applied to both the upper portion of the both ends of the conductor 4 and the lower portion of the both ends of the conductor 4. As a result, the conductor 4 can be sandwiched with the conductor crimping pieces 13. Consequently, as shown in FIG. 10, the conductor 4 can be certainly bent along the groove 4*a*, and attached to the terminal 6.

Figure 14:
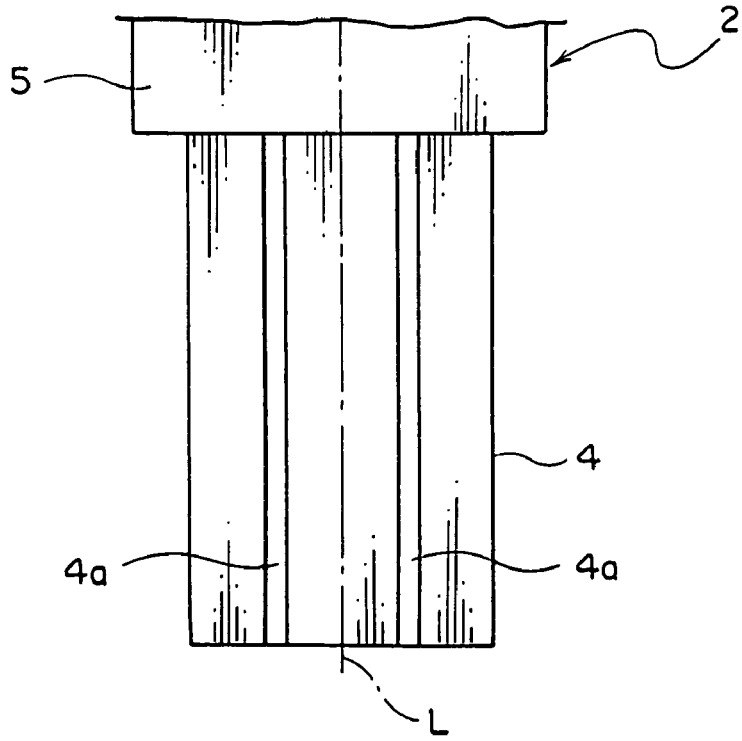
FIG. 14 is a partly top view of another embodiment of the FFC 2.
Figure 15:
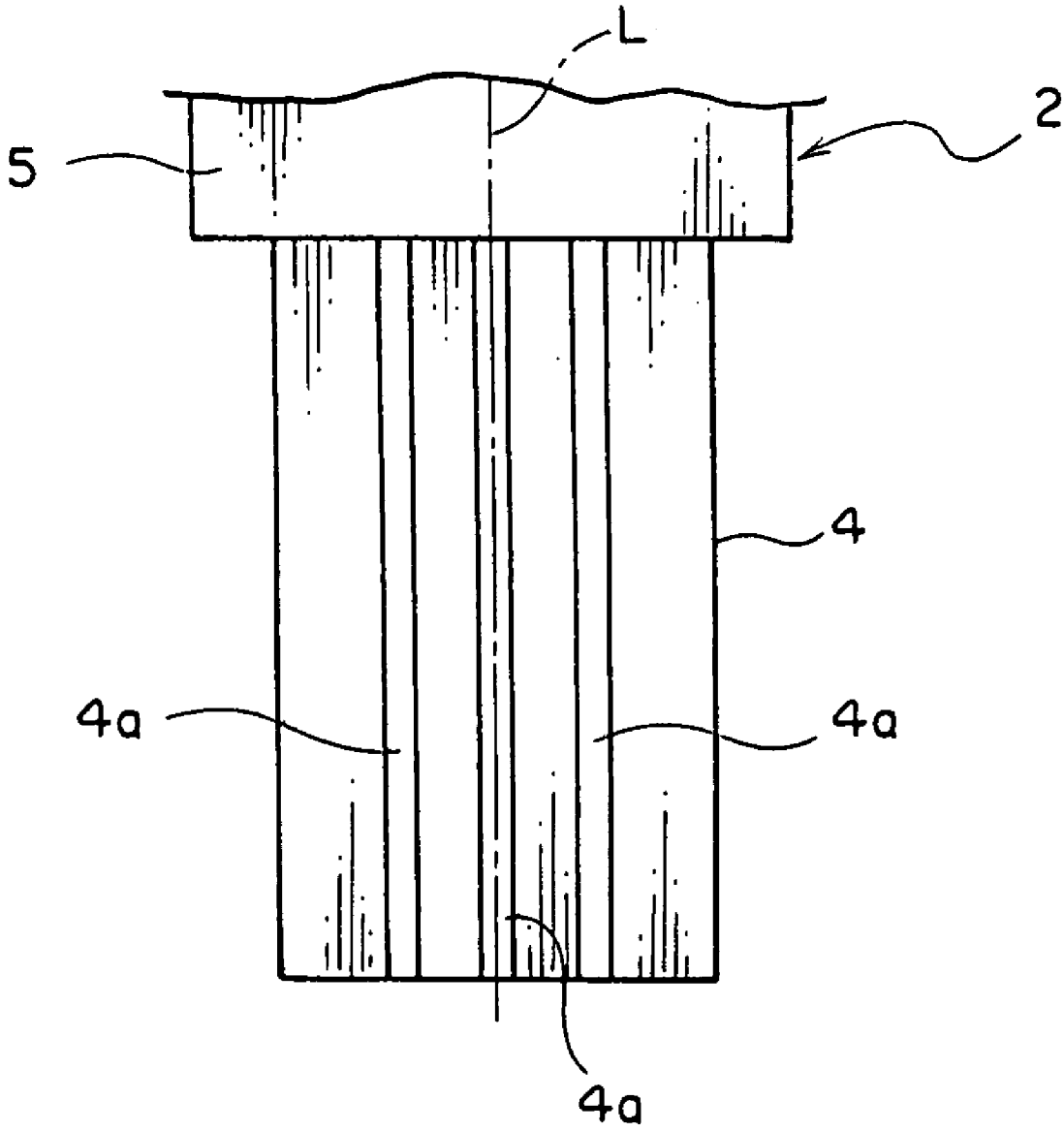
FIG. 15 is a partly top view of another embodiment of the FFC 2.

In the embodiment of the present invention, one groove 4*a* is arranged at the center of the conductor 4 in the width direction Y2. However, the present invention is not limited thereto. As shown in FIG. 14, a pair of the grooves 4*a* can be symmetrically arranged along a line L of the center of the conductor 4 in the longitudinal direction Y1. In addition, the groove can be added to the pair of the grooves the conductor 4. Furthermore, as shown in FIG. 15, three grooves 4*a* can be arranged on the conductor 4. One of the grooves 4*a* can be placed on the center of the conductor 4 and the others of the grooves 4*a* can be placed on symmetric position along the line L.

Therefore, the conductor 4 can be bent along the grooves 4*a* shown in FIGS. 14 and 15, and be changed without deformation by being bent to one side of the pair of the conductor crimping pieces 13.

Additionally, in the embodiment of the present invention, the groove 4*a* is formed with a V-shaped section. However, the present invention is not limited thereto. The groove 4*a* can be formed with various shapes. That is, it is only required that the groove 4*a* is disposed along the longitudinal direction Y1 of the conductor 4.

On the other hand, when bending to one side is no problem, it is not required to arrange the groove 4*a* at the center in the width direction Y2 or to symmetrically dispose a pair of the groove 4*a* along the center line of the conductor. Thus, the groove 4*a* can be arranged anywhere in the conductor 4 along the longitudinal direction Y1.

The embodiment of the present invention is only exemplary and not limited thereto. Modifications are possible within the scope of the present invention.

What is claimed is:

1. A flat circuit device comprising:

a belt-shaped conductor; and a covering portion for covering the conductor;

wherein the conductor has a groove along a longitudinal direction thereon, and is fixed in a terminal by placing on a bottom wall sandwiched between a pair of crimping pieces of the terminal and by crimping the pair of the crimping pieces.

2. The flat circuit device as claimed in claim 1, wherein slope faces sloped in a direction away from the bottom wall are arranged on both ends in the width direction of the conductor.

3. The flat circuit device as claimed in claim 1, wherein at least a pair of the grooves is symmetrically arranged on the conductor along a line at the center of the width direction extending in a longitudinal direction.

4. The flat circuit device as claimed in claim 3, wherein slope faces sloped in a direction away from the bottom wall are arranged on both ends in the width direction of the conductor.

5. The flat circuit device as claimed in claim 1, wherein the groove is arranged on the center of the conductor in a width direction.

6. The flat circuit device as claimed in claim 5, wherein slope faces sloped in a direction away from the bottom wall are arranged on both ends in the width direction of the conductor.

7. The flat circuit device as claimed in claim 5, wherein at least a pair of the grooves is symmetrically arranged on the conductor along a line at the center of the width direction extending in a longitudinal direction.

8. The flat circuit device as claimed in claim 7, wherein slope faces sloped in a direction away from the bottom wall are arranged on both ends in the width direction of the conductor.

* * * * *